US005272974A

United States Patent [19]

Guarino et al.

[11] Patent Number: 5,272,974

[45] Date of Patent: Dec. 28, 1993

[54] OFFSET PRINTING APPARATUS WITH PRINTING PLATE CYLINDER ADJUSTMENT

[75] Inventors: Jean-Louis Guarino, St-Cyr-en-Val; Bernard Six, Olivet, both of France

[73] Assignee: Komori-Chambon S.A., Orleans, France

[21] Appl. No.: 41,482

[22] Filed: Apr. 1, 1993

[30] Foreign Application Priority Data

Apr. 3, 1992 [FR] France ..... 92 04114

[51] Int. Cl.[5] ..... B41F 7/02

[52] U.S. Cl. ..... 101/218; 101/247; 101/181

[58] Field of Search ..... 101/139, 140, 218, 247, 101/248, 216, 181, 180, 177, 143

[56] References Cited

U.S. PATENT DOCUMENTS

| | | | |
|---|---|---|---|
| 913,119 | 2/1909 | Ford | 101/218 |
| 1,231,932 | 7/1917 | Olsen | 101/247 |
| 1,330,793 | 2/1920 | Friess | 101/247 |
| 1,816,796 | 7/1931 | Rössger | 101/247 |
| 3,470,816 | 10/1969 | Piecha et al. | 101/218 |
| 4,458,590 | 7/1984 | Egnaczak | 101/218 |
| 4,462,311 | 7/1984 | Armelin | 101/143 |
| 5,186,103 | 2/1993 | Gelinas et al. | 101/181 |

FOREIGN PATENT DOCUMENTS

| | | |
|---|---|---|
| 0095423 | 11/1983 | European Pat. Off. . |
| 2391073 | 12/1978 | France . |

*Primary Examiner*—Eugene H. Eickholt
*Attorney, Agent, or Firm*—McAulay Fisher Nissen Goldberg & Kiel

[57] ABSTRACT

Disclosed is an offset printing apparatus, wherein the bearings of the blanket cylinder are mounted fixed on the cheeks of the cassette; the bearings of the plate cylinder comprise means for adjusting the position of the axis of the plate cylinder; and each of the front and rear cheeks of the cassette bears a mechanism for connection between mobile control means of the printing apparatus and the means for adjusting the bearings of the plate cylinder, in order to adjust the position of the axis of this cylinder as a function of the printing conditions required.

8 Claims, 3 Drawing Sheets

OFFSET PRINTING APPARATUS WITH PRINTING PLATE CYLINDER ADJUSTMENT

FIELD OF THE INVENTION

The present invention relates to an offset printing apparatus.

BACKGROUND OF THE INVENTION

Offset printing apparatus generally comprise a plate cylinder tangential to a blanket cylinder, with a supple superficial layer, which transfers a layer of ink onto a web of material to be printed advancing between the blanket cylinder and an impression cylinder applied under pressure against the former, this impression cylinder being able to be constituted by a blanket cylinder in the case of recto-verso printing on the web. In certain apparatus, the plate cylinder and the blanket cylinder are mounted between the two lateral cheeks of a removable cassette which may be displaced transversely with respect to the printing apparatus, i.e. perpendicularly to the direction of advance of the web to be printed.

In these offset printing apparatus incorporating a removable cassette, the various adjustments necessary for printing are obtained by wedging the cylinders either with the aid of cams or by the application of the cylinders on sloping shims. As a general rule, wedging between the plate cylinder and the blanket cylinder is effected by a displacement of the blanket cylinder; the skewing, i.e. the slight relative inclination of the axes of the plate and blanket cylinders, is effected by a displacement of the plate cylinder; and the wedging between the blanket cylinder and the impression cylinder (or other blanket cylinder) is effected by the displacement of the impression cylinder. With such a type of assembly, all the cylinders must have a possibility of displacement in order to be able to perform the functions of printing. Now, it is known that, in order to obtain high-quality printing, the blanket cylinder must be as rigid as possible and, to that end, cams must be produced, with a view to the displacement of the blanket cylinder, having clearances of some micrometers and most often with a supply of a lubricant under pressure in order to have relatively easy manoeuvre and minimum wear in time. This type of solution is therefore relatively expensive in order to have a correct printing function.

It is an object of the present invention to overcome this drawback by providing an offset printing apparatus of the type incorporating a removable cassette, of reduced overall cost due to a considerable simplification of its assembly.

SUMMARY OF THE INVENTION

To that end, this offset printing apparatus comprising a frame in which may be mounted a removable cassette bearing a plate cylinder and a blanket cylinder with parallel axes tangential to each other, a web to be printed advancing between the blanket cylinder and an impression cylinder, mounted mobile on the frame of the apparatus and being able to be applied against the blanket cylinder, the plate and blanket cylinders being engaged in front bearings and in rear bearings respectively borne by front and rear cheeks of the cassette, is characterized in that the bearings of the blanket cylinder are mounted fixed on the cheeks of the cassette; in that the bearings of the plate cylinder comprise means for adjusting the position of the axis of the plate cylinder; and in that each of the front and rear cheeks of the cassette bears a mechanism for connection between mobile control means of the printing apparatus and the means for adjusting the bearings of the plate cylinder, in order to adjust the position of the axis of this cylinder as a function of the printing conditions required.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
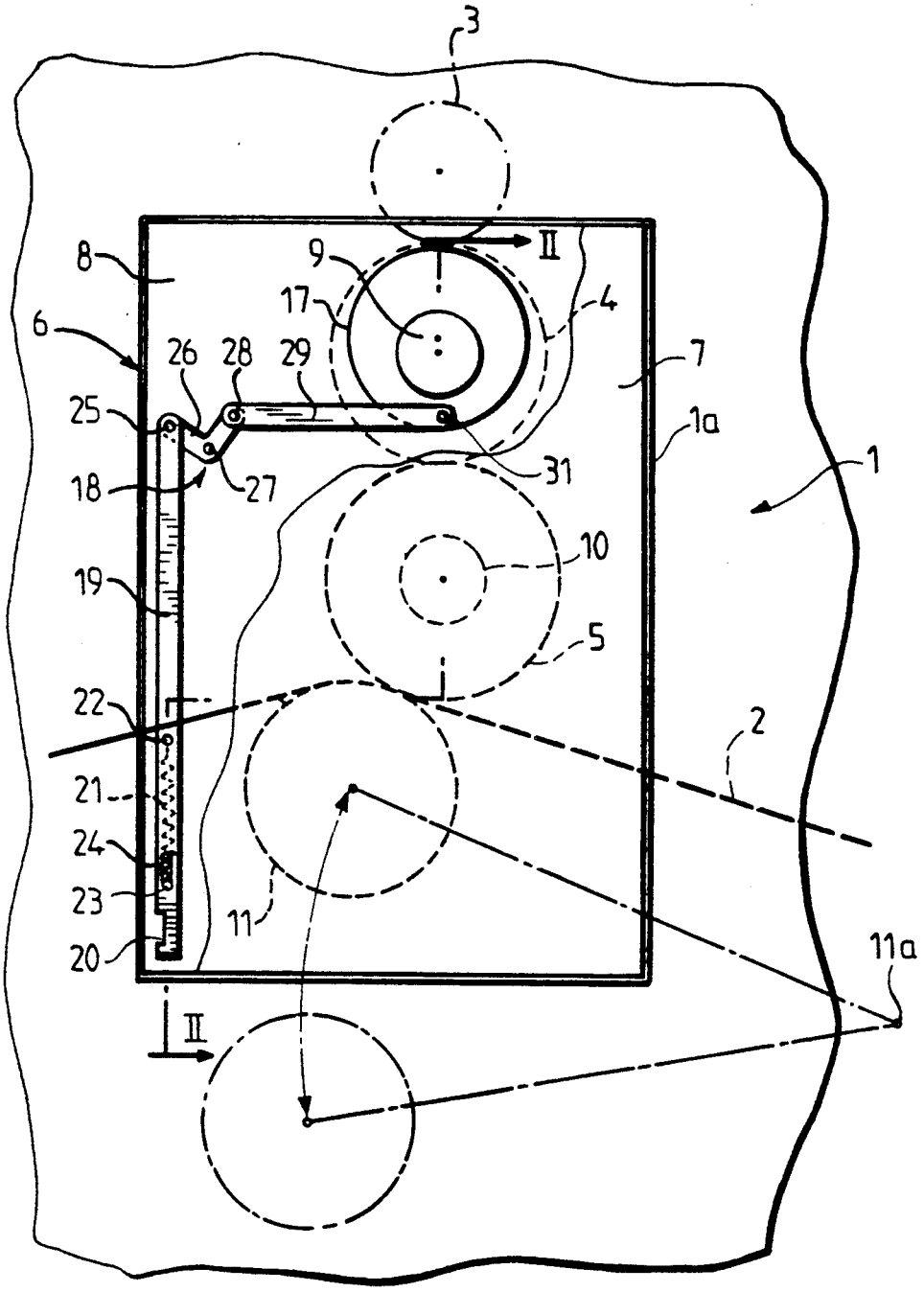
FIG. 1 is a schematic view in elevation, with parts torn away, of an offset printing apparatus according to the invention.

Referring now to the drawings, the offset printing apparatus according to the invention, which is shown in simplified form in FIG. 1, comprises a frame 1 essentially constituted by longitudinal and vertical uprights, parallel to one another, connected by crosspieces (not shown) and between which extend, horizontally and transversely, the different cylinders of the printing apparatus. In the present description, the term "longitudinal" signifies parallel to the direction of advance of a web 2 to be printed, traversing the apparatus, whilst the term "transverse" signifies "horizontal and perpendicular to the direction of advance of the web" or "perpendicular to the plane of the drawing".

The cylinders of the apparatus, with parallel axes tangential to one another, may be disposed vertically, being superposed with respect to one another, as shown in the drawing, or horizontally, or in any other arrangement. In the non-limiting embodiment of the offset printing apparatus which is shown, this apparatus comprises an upper inking roller 3 mounted to rotate on the frame 1 of the apparatus and depositing a film of ink on a plate cylinder 4 disposed therebeneath. This plate cylinder 4 is tangential to a lower blanket cylinder 5 and is mounted, jointly with this blanket cylinder 5, on a removable cassette 6. This cassette 6 essentially comprises two vertical and longitudinal, lateral cheeks, namely a front cheek 7 and a rear cheek 8 braced by appropriate horizontal crosspieces (not shown). The two cheeks 7, 8 constitute supports for respective shafts 9, 10 of the plate (4) and blanket (5) cylinders. The assembly of the cassette 6 may be drawn, in the horizontal and transverse direction, to outside the frame 1 of the printing apparatus and positioned inside this frame 1, for example by passing through an opening 1*a* provided in the front upright of the frame 1. Below the blanket cylinder 5, the printing apparatus comprises an impression cylinder 11, of transverse axis. It should be noted that, in certain apparatus allowing recto-verso printing on the web 2, the impression cylinder 11 also constitutes a second blanket cylinder. This impression cylinder 11 is borne by a vertically mobile equipment so as to be able to occupy a lower end position which is indicated in dashed and dotted lines in FIG. 1 and in which it is retracted below the lower edge of the opening 1*a* of the frame 1. In this retracted position, the impression cylinder 11 allows the cassette 6 to be extracted outside the printing apparatus and re-introduced therein, by a movement in the transverse direction. On the other hand, in printing position, it is in upper position, as shown in FIG. 1, and it is tangential to the lower part of the blanket cylinder 5, the web 2 to be printed then being gripped between the two cylinders 5 and 11. The mobile equipment bearing the impression cylinder 11 may be constituted, for example, by a support oscillating about an axis 11*a*.

The shaft 9 of the plate cylinder 4 is extended, at its ends, by front (9*a*) and rear (9*b*) journals respectively housed in front (12) and rear (12*a*) bearings. In the same way, the shaft 10 of the blanket cylinder 5 is extended, at its ends, by front (10*a*) and rear (10*b*) journals respectively housed in front (13) and rear (13*a*) bearings. According to the invention, the two bearings 13, 13*a* supporting the shaft 10 of the blanket cylinder 5 are mounted fixed on the front (7) and rear (8) cheeks respectively of the cassette 6, whilst the bearings 12, 12*a* supporting the shaft 9 of the plate cylinder 4 are mounted to be adjustable on these cheeks. To that end, each of the bearings 12, 12*a* of the shaft 9 comprises a roller bearing 14, for example a needle bearing, in which the corresponding journal 9*a*, 9*b* is engaged and which is housed in an eccentric bore of a bush 15. This bush 15 is fixed at one end, by means of screws 16, to a maneouvring flange 17 located for example inside the corresponding cheek 7, 8. As the bore of the bush 15 which receives the roller bearing 14 is eccentric with respect to the axis of this bush 15, a rotation of the bush 15 about its axis brings about a vertical displacement of the axis of the roller bearing 14, i.e. of the shaft 9 of the plate cylinder 4.

Figure 3:
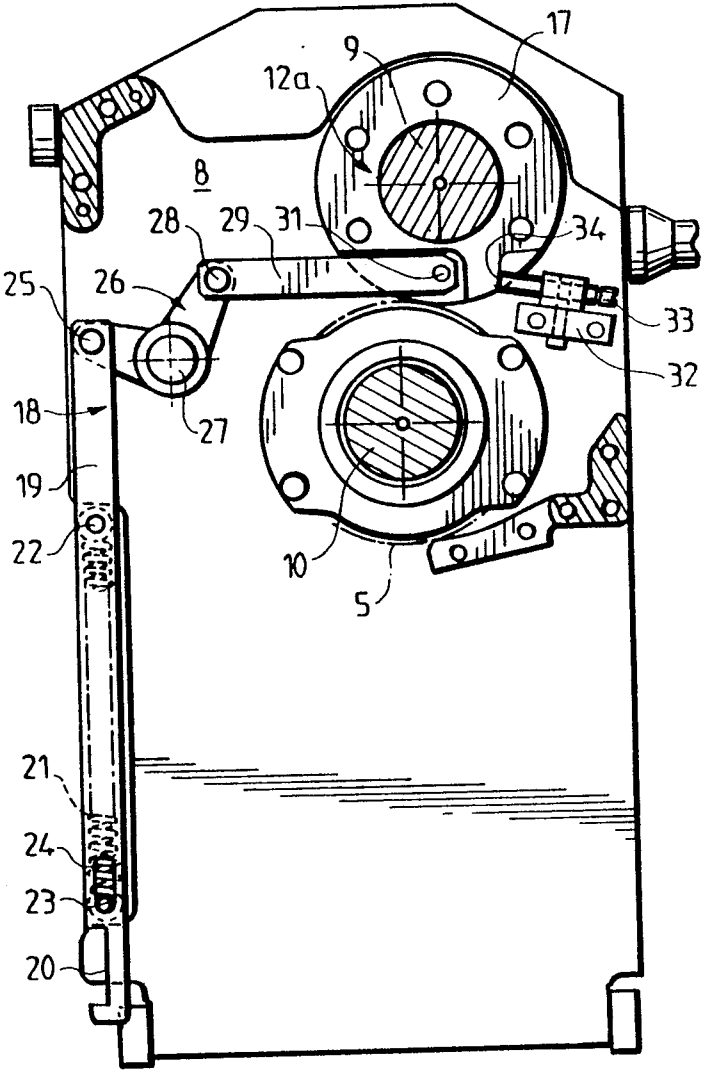
FIG. 3 is a vertical and longitudinal (with respect to the web) view in section, taken along line III—III of FIG. 2.

The assembly constituted by the bush 15 and its manoeuvring flange 17 will be considered hereinafter as constituting a cam. The control of the movement of rotation of this cam is effected, on each of the cheeks 7, 8, by the same connection mechanism and the connection mechanism 18 which is mounted on the rear cheek 8 of the cassette and which controls adjustment of the rear bearing 12*a* will alone be described now, more particularly with reference to FIGS. 1 and 3. This mechanism comprises a vertical bar 19 which is mounted to move vertically and which extends near the inner face of the rear cheek 8, along one of its vertical edges. This manoeuvring bar 19 is provided to be actuated, at its lower end, by a control device provided on the frame of the printing apparatus, in order to raise it. To that end, the bar 19 may present, in its lower end part, a notch 20 able to couple with a manoeuvring member forming part of the control device. The bar 19 is returned into lower end position by a draw spring 21 which extends vertically and which is hooked, at its upper end, to a finger 22 fast with the bar 19 and, at its lower end, to a finger 23 fixed to the cheek 8. This finger 23 is engaged through a vertical oblong slot 24 pierced in the bar 19 in order to limit the vertical movement thereof. At its upper end, the manoeuvring bar 19 is articulated, about an axis 25, on the end of an arm of a bent lever 26 mounted to pivot on the cheek 8, about a horizontal and transverse axis 27. The other arm of the bent lever 27 is articulated, about an axis 28, on one end of a substantially horizontal connecting rod 29 of which the other end is articulated, about an axis 31, on the lower part of the flange 17 forming part of the cam 15–17. The vertical manoeuvring bar 18 is shown in upper end position in which it is raised by the control device of the printing apparatus and this position corresponds to a position of the cam 15–17 for which the axis of the bearing 12*a* and consequently of the shaft 9 is in lower end position. When the manoeuvring bar 18 is no longer maintained raised, it is returned downwardly by its return spring 21, which brings about a rotation of the cam 15–17 and an upward shift of the axis of the roller bearing 14 and of the shaft 9.

The upper end position of the manoeuvring bar 19 and consequently the end position in rotation of the cam 15–17 are determined by an adjustable stop 32 with adjusting screw 33. This adjustable stop 32 which determines the position set under pressure, is fixed on the inner face of the cheek 8 and the adjusting screw is mounted in this stop so that its end is in contact with a bearing surface 34 provided in the lower part of the flange 17.

One of the bearings of the shaft 9 of the plate cylinder 4, in the example described the front bearing 12, is in addition slightly adjustable in the horizontal and longitudinal direction in order to allow an adjustment of the bias between the two cylinders 4 and 5, i.e. of the mutual inclination, in a horizontal plane, of their respective axes. To that end, the bush 15 of the cam 15–17 of the bearing 12*a* is itself housed in a second roller bearing 35, for example a needle bearing, disposed inside an eccentric bore of a second bush 36 mounted to rotate, about its axis, in the front cheek 7 via a third roller bearing 37. The bush 36 with eccentric bore is fast, outside the front cheek 7, with a flange 38 bearing a manoeuvring stud 39. Consequently, when the second bush 36 is rotated, a horizontal displacement, in one direction or in the other, of the first bush 15 and of the journal 9*a* of the shaft 9 is provoked, which thus enables the bias of this shaft with respect to the shaft 10 of the blanket cylinder 5, to be adjusted.

The two cylinders 4, 5 are driven in rotation at the rear of the apparatus. To that end, the rear journals 9*b*, 10*b* of the two shafts 9 and 10 are respectively fast with two pinions 41 and 42, with the same primitive diameter, in mesh with each other. When the cassette 6 is engaged in the frame 1 of the printing apparatus, one of the pinions 41, 42 meshes in turn with a drive pinion (not shown), which is mounted to rotate on the frame 1 of the printing apparatus and which is driven in rotation by a general control device of the apparatus. Consequently, the two plate (4) and blanket (5) cylinders are driven in rotation in opposite directions from each other, at the same peripheral speed.

Figure 2:
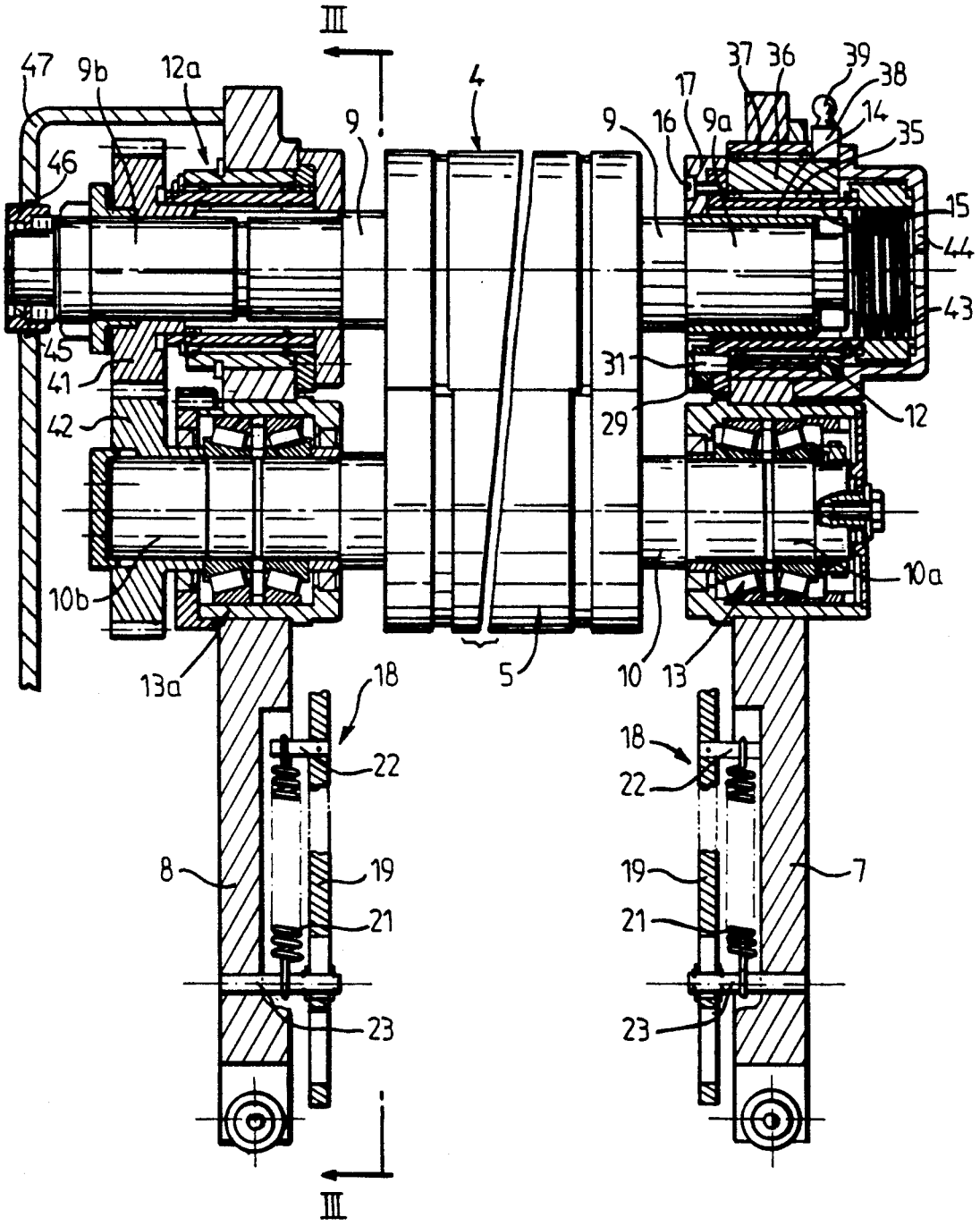
FIG. 2 is a vertical and transverse (with respect to the web) view in section, on a larger scale, taken along line II—II of FIG. 1.
Figure 4:
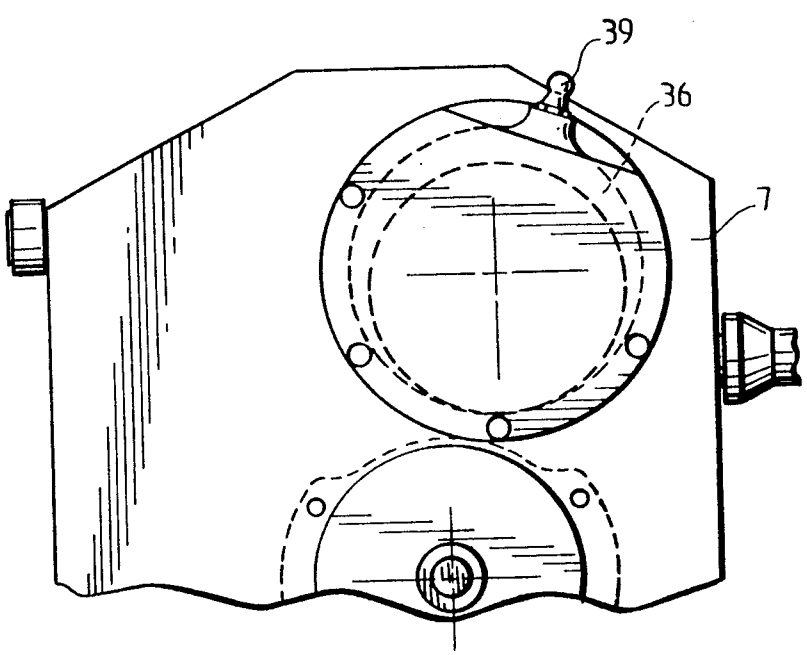
FIG. 4 is a view in elevation (taken from the right in FIG. 2) of the front cheek of the removable cassette.

As may be seen in FIG. 2, the shaft 9 of the plate cylinder 4 is also mounted so as to be able to slide transversely in order to allow a lateral adjustment of the cliché plate that the cylinder 4 bears. To that end, the front journal 9*a* of the shaft 9 is subjected to the action of a compression spring 43 tending to push the shaft 9 in the direction of the rear cheek 8. This compression spring may advantageously be constituted by a stack of Belleville washers contained in a housing 44. Furthermore, the rear journal 9*b* of the shaft 9 is housed to rotate, via a roller bearing 45, in a thrust bearing 46 mounted to slide in an opening of a housing 47 fixed outside the rear cheek 8. The thrust bearing 46 is intended to cooperate with a mobile adjusting arm (not shown) provided at the rear of the apparatus. Consequently, by causing the thrust bearing 46 to slide more or less in the opening of the housing 47, this arm makes it possible to push the shaft 9 more or less forwardly and thus to adjust the plate in the lateral direction.

What is claimed is:

1. An offset printing apparatus, of variable format, comprising a frame in which may be mounted a removable cassette bearing a plate cylinder and a blanket cylinder with parallel axes tangential to each other, a web to be printed advancing between the blanket cylinder and an impression cylinder, mounted mobile on the frame of the apparatus and being able to be applied against the blanket cylinder, the plate and blanket cylinders being engaged in front bearings and in rear bearings respectively borne by front and rear cheeks of the cassette, wherein the bearings of the blanket cylinder are mounted fixed on the cheeks of the cassette;

the bearings of the plate cylinder comprise means for adjusting the position of the axis of the plate cylinder, and each of the front and rear cheeks of the cassette bears a mechanism for connection between mobile control means of the printing apparatus and the means for adjusting the bearings of the plate cylinder, in order to adjust the position of the axis of this cylinder as a function of the printing conditions required.

2. The apparatus of claim 1, wherein each of the front and rear bearings of the plate cylinder comprises means for adjusting the position of the axis of the plate cylinder with respect to the position of the axis of the blanket cylinder.

3. The apparatus of claim 2, wherein the means for adjusting the position of the axis of the plate cylinder with respect to the axis of the blanket cylinder in the vertical direction comprise a first roller bearing in which is engaged the end part of the shaft of the plate cylinder and which is housed in an eccentric bore of a bush mounted to rotate, about its axis, in the corresponding cheek.

4. The apparatus of claim 3, wherein the first bush is fast, at one end, with a manoeuvring flange located on one side of the corresponding cheek and this flange is coupled to the connection mechanism.

5. The apparatus of claim 4, wherein the flange of the bush presents a bearing surface coming into contact with an adjustable stop, borne by the cheek, to limit the rotation of the bush and determine the position set under pressure.

6. The apparatus of claim 4, wherein the connection mechanism comprises a manoeuvring bar mounted to move vertically along the corresponding cheek, returned into lower end position by a spring and being able to be raised by mobile control means of the printing apparatus, this manoeuvring bar being coupled, via a bent lever and a connecting rod, to the flange fast with the first bush.

7. The apparatus of claim 3, wherein the means for adjusting the position of the axis of the plate cylinder comprise a second roller bearing in which is housed the first bush and which itself is disposed inside an eccentric bore of a second bush mounted to rotate, about its axis, in the corresponding cheek, via a third roller bearing, the second bush with eccentric bore being fast, outside the cheek, with a manoeuvring member allowing it to be driven in rotation.

8. The apparatus of claim 1, wherein the shaft of the plate cylinder is mounted so as to be able to slide axially in its bearings, it is urged axially, in one direction, at one of its ends, by a spring so as to be constantly pushed in the direction of the other cheek, and on its other end, projecting outside the other cheek, there is mounted a thrust bearing which may be actuated axially by a mobile adjusting arm mounted on the apparatus.

* * * * *